US011626664B2

(12) United States Patent
Kosaka et al.

(10) Patent No.: US 11,626,664 B2
(45) **Date of Patent: *Apr. 11, 2023**

(54) ANTENNA

(71) Applicant: JAPAN AVIATION ELECTRONICS INDUSTRY, LIMITED, Tokyo (JP)

(72) Inventors: Keishi Kosaka, Tokyo (JP); Hiroshi Toyao, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/008,776

(22) Filed: Sep. 1, 2020

(65) Prior Publication Data

US 2021/0126367 A1 Apr. 29, 2021

(30) Foreign Application Priority Data

Oct. 29, 2019 (JP) ..... JP2019-196290

(51) Int. Cl.

| | |
|---|---|
| ***H01Q 7/00*** | (2006.01) |
| ***H01Q 1/50*** | (2006.01) |
| ***H01Q 9/04*** | (2006.01) |
| ***H01Q 5/10*** | (2015.01) |

(52) U.S. Cl.

CPC ..... *H01Q 7/00* (2013.01); *H01Q 1/50* (2013.01); *H01Q 5/10* (2015.01); *H01Q 9/0485* (2013.01)

(58) Field of Classification Search

CPC .. H01Q 7/00; H01Q 1/50; H01Q 5/10; H01Q 9/0485

USPC ..... 343/866

See application file for complete search history.

(56) References Cited

U.S. PATENT DOCUMENTS

| | | | | |
|---|---|---|---|---|
| 7,113,143 | B2 | 9/2006 | Minemura | |
| 7,579,992 | B2 | 8/2009 | Ryou et al. | |
| 8,081,120 | B2 * | 12/2011 | Yoshioka | H01Q 9/42 343/702 |
| 8,164,524 | B2 * | 4/2012 | Tang | H01Q 5/364 343/702 |
| 8,482,451 | B2 * | 7/2013 | Burd | H01Q 1/2225 342/5 |
| 9,136,594 | B2 * | 9/2015 | Shi | H01Q 9/0421 |
| 9,496,616 | B2 | 11/2016 | Toyao | |
| 9,502,761 | B2 | 11/2016 | Itoh et al. | |
| 10,218,071 | B2 | 2/2019 | Toyao | |

(Continued)

FOREIGN PATENT DOCUMENTS

| | | |
|---|---|---|
| CN | 1266803 C | 7/2006 |
| EP | 3001503 A1 | 3/2016 |

(Continued)

OTHER PUBLICATIONS

Extended European Search Report (EESR) dated Feb. 22, 2021 issued in counterpart European Application No. 20193677.0.

(Continued)

*Primary Examiner* — Hai V Tran

(74) *Attorney, Agent, or Firm* — Holtz, Holtz & Volek PC

(57) ABSTRACT

Antenna has a split ring resonator. Moreover, the antenna is provided with a first conductor and a second conductor which form, at least in part, an open stub or a short stub which has a predetermined electrical length. With this structure, the antenna can have a plurality of operating frequencies.

8 Claims, 12 Drawing Sheets

(56) References Cited

U.S. PATENT DOCUMENTS

| | | | | |
|---|---|---|---|---|
| 10,340,609 | B2 | 7/2019 | Kosaka et al. | |
| 10,367,248 | B2 | 7/2019 | Toyao et al. | |
| 10,374,318 | B2 | 8/2019 | Moldovan | |
| 10,403,976 | B2 | 9/2019 | Uchida | |
| 11,101,563 | B2 | 8/2021 | Hashiguchi et al. | |
| 11,380,997 | B2 * | 7/2022 | Kosaka | H01Q 1/36 |
| 2005/0259030 | A1 * | 11/2005 | Mizuno | H01Q 1/38 343/866 |
| 2006/0220977 | A1 * | 10/2006 | Ogino | H01Q 19/005 343/866 |
| 2006/0279464 | A1 | 12/2006 | Mei | |
| 2007/0040747 | A1 * | 2/2007 | Kinezos | H01Q 13/085 343/702 |
| 2007/0236391 | A1 * | 10/2007 | Ryou | H01Q 1/36 343/700 MS |
| 2009/0237311 | A1 * | 9/2009 | Wu | H01Q 1/2258 343/702 |
| 2009/0256763 | A1 * | 10/2009 | Chi | H01Q 7/00 343/741 |
| 2012/0268330 | A1 | 10/2012 | Irmscher et al. | |
| 2014/0203993 | A1 * | 7/2014 | Toyao | H01Q 13/10 343/867 |
| 2016/0294048 | A1 | 10/2016 | Xu et al. | |
| 2018/0062271 | A1 | 3/2018 | Toyao | |
| 2019/0214730 | A1 * | 7/2019 | Hsiao | H01Q 21/245 |
| 2021/0126373 | A1 * | 4/2021 | Kosaka | H01Q 5/10 |

FOREIGN PATENT DOCUMENTS

| | | | | |
|---|---|---|---|---|
| JP | 2005203854 | A | 7/2005 | |
| JP | WO 2013/027824 | * | 2/2013 | H01Q 7/00 |
| JP | 2015185910 | A | 10/2015 | |
| JP | 2016063449 | A | 4/2016 | |
| JP | 5020451 | B2 | 10/2016 | |
| JP | 2016225956 | A | 12/2016 | |
| JP | 2018174585 | A | 11/2018 | |
| JP | 2019047183 | A | 3/2019 | |
| JP | 2019050641 | A | 3/2019 | |
| KR | 20040053741 | A | 6/2004 | |
| KR | 20060029594 | A | 4/2006 | |
| KR | 20070113852 | A | 11/2007 | |
| KR | 20110010416 | A | 2/2011 | |
| WO | 2015029383 | A1 | 3/2015 | |
| WO | 2016132712 | A1 | 8/2016 | |

OTHER PUBLICATIONS

Korean Office Action (and English language translation thereof) dated Jul. 21, 2021 issued in counterpart Korean Application No. 10-2020-0113662.

Taiwanese Office Action (and English language translation thereof) dated Jul. 8, 2021, issued in counterpart Taiwanese Application No. 109130911.

U.S. Appl. No. 17/008,788; First Named Inventor: Keishi Kosaka; Title: "Antenna"; filed Sep. 1, 2020.

Non-Final Office Action dated Nov. 26, 2021, issued in related U.S. Appl. No. 17/008,788.

European Office Action dated Oct. 15, 2021, issued in counterpart European Application No. 20193677.0.

Extended European Search Report (EESR) dated Feb. 23, 2021 issued in European Application No. 20193686.1.

Korean Office Action (and English language translation thereof) dated Jul. 21, 2021 issued in counterpart Korean Application No. 10-2020-0113802.

Taiwanese Office Action (and English translation thereof) dated Jun. 30, 2021 issued in counterpart Taiwanese Application No. 109130910.

Taiwanese Office Action dated Mar. 23, 2021 (and English translation thereof) issued in Taiwanese Application No. 109130910.

Related U.S. Appl. No. 17/008,788; First Named Inventor: Keishi Kosaka; Title: "Antenna"; filed Sep. 1, 2020.

Taiwanese Office Action (and English language translation thereof) dated Nov. 29, 2021, issued in counterpart Taiwanese Application No. 109130910.

European Office Action dated Jun. 14, 2022, issued in counterpart European Application No. 20193677.0.

Taiwanese Office Action (and English language translation thereof) dated Jul. 22, 2022, issued in counterpart Taiwanese Application No. 109130911.

* cited by examiner

ANTENNA

CROSS REFERENCE TO RELATED APPLICATIONS

This application is based on and claims priority under 35 U.S.C. § 119 to Japanese Patent Application No. JP2019-196290 filed Oct. 29, 2019, the contents of which are incorporated herein in their entirety by reference.

BACKGROUND OF THE INVENTION

This invention relates to an antenna.

JP 6020451 B (Patent Document 1) discloses a small wideband antenna. As shown in FIG. 24, an antenna 90 has a split ring resonator 96 using a split ring 94 which is a ring-shaped conductor with a split or a split portion 92.

The antenna 90 of Patent Document 1 can resonate at one operating frequency but not meet multiband.

SUMMARY OF THE INVENTION

It is an object of the present invention to provide an antenna having a structure which can resonate at a plurality of operating frequencies.

One aspect of the present invention provides an antenna having a split ring resonator. The antenna comprises a first conductor and a second conductor which form, at least in part, an open stub or a short stub which has a predetermined electrical length. The antenna has a plurality of operating frequencies.

By combining an antenna having a split ring resonator with a first conductor and a second conductor which form, at least in part, an open stub or a short stub which has a predetermined electrical length, it is possible to provide an antenna which is small and has a plurality of operating frequencies.

An appreciation of the objectives of the present invention and a more complete understanding of its structure may be had by studying the following description of the preferred embodiment and by referring to the accompanying drawings.

Figure 1:
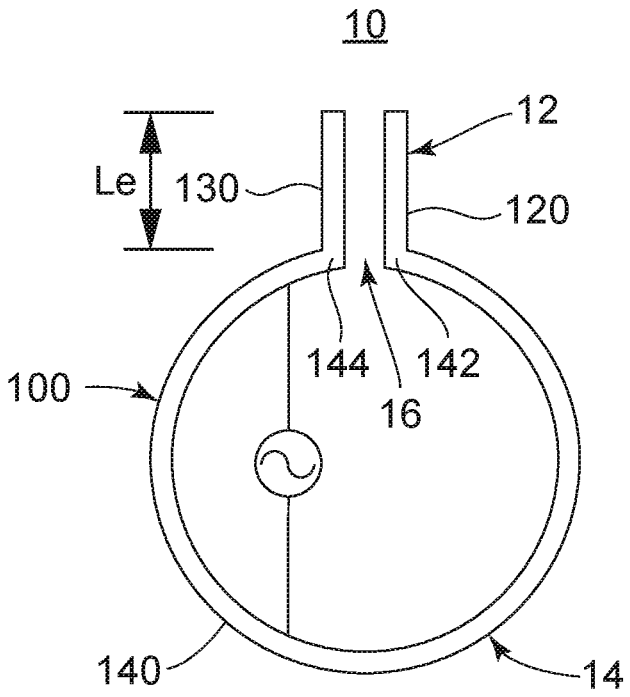
FIG. 1 is a diagram showing a basic structure of an antenna of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

First, referring to FIG. 1, the description will be made about a basic structure of an antenna according to the present invention. An antenna 10 of FIG. 1 is provided with a stub 12 and a split ring 14. The stub 12 is formed of a pair of conductors, a first conductor 120 and a second conductor 130, arranged apart from and in parallel with each other. The split ring 14 is formed of a ring-shaped conductor, or a third conductor 140, with a split or a split portion 16. The first conductor 120 and the second conductor 130 are connected to a first end portion 142 of the third conductor 140 and a second end portion 144 of the third conductor 140, respectively.

As understood from FIG. 1, the third conductor 140 has a ring shape and forms an inductor. Moreover, the end portions of the third conductor 140, i.e. the first end portion 142 and the second end portion 144, are apart from and face each other to form a capacitor. Additionally, in the present specification, the word "ring shape" has a wide meaning including "circular frame shape", "ellipse or oval frame shape" and "polygonal frame shape".

As shown in FIG. 1, the first conductor 120 and the second conductor 130 (the stub 12) have an electrical length Le. The electrical length Le is a predetermined electrical length which is a length equal to or longer than a necessary length necessary for the first conductor 120 and the second conductor 130 to form a distributed parameter line at a predetermined frequency band. In other words, the first conductor 120 and the second conductor 130 form a transmission line having the predetermined electrical length. Since the stub 12 has the predetermined electrical length, it operates inductively or capacitively according to a frequency of an input power.

Figure 23:
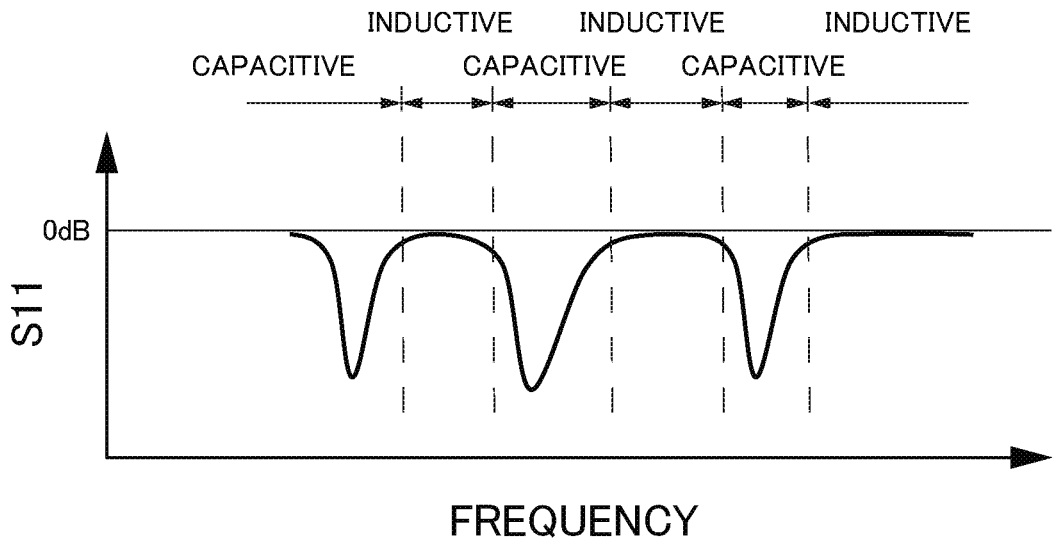
FIG. 23 is a graph showing relationship between frequencies supplied to the antenna of FIG. 1 and reflection coefficients S11. Frequency bands at which a stub operates capacitively are represented by "capacitive". Other frequency bands at which the stub operates inductively are represented by "inductive".
Figure 24:
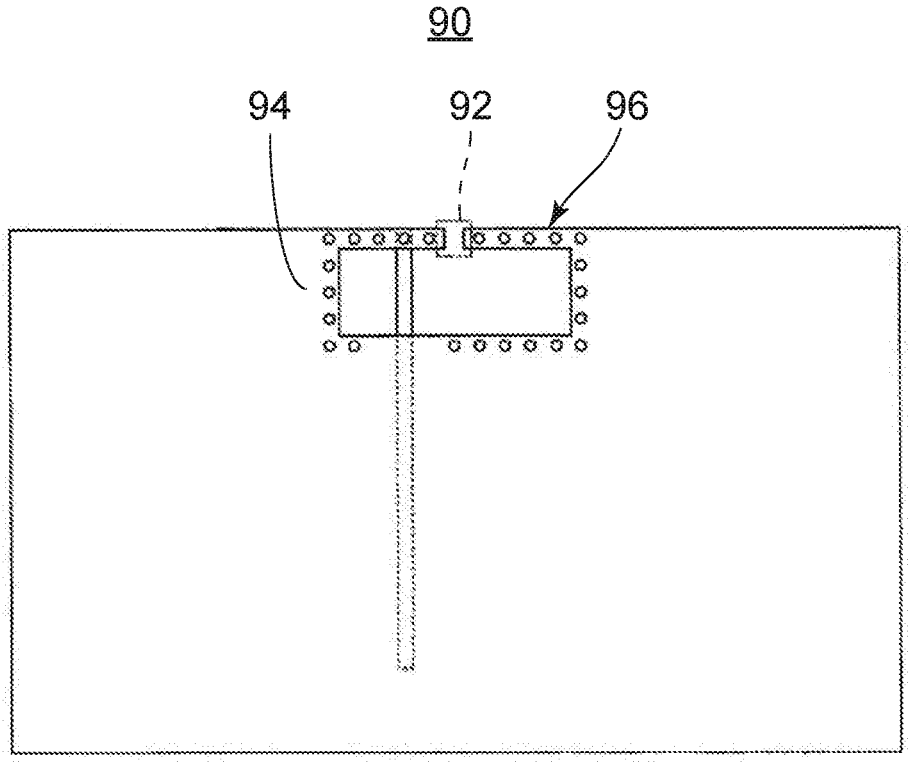
FIG. 24 PRIOR ART
FIG. 24 is a top view showing an antenna disclosed in Patent Document 1.

As understood from FIG. 1, the stub 12 and the split ring 14 as a whole form a split ring resonator 100. The split ring resonator 100 operates as an LC resonator which is formed of a capacitor formed of the stub 12, another capacitor formed of the split ring 14 and an inductor formed of the split ring 14. Since the stub 12 operates inductively or capacitively in accordance with the frequency supplied to the third conductor 140, the split ring resonator 100 can have a plurality of resonance frequencies. In detail, as understood from FIG. 23, the split ring resonator 100 causes LC resonance at frequencies at which the stub 12 becomes capacitive. There is a plurality of frequencies each of which makes the stub 12 capacitive. An operating frequency band of the split ring resonator 100 is a frequency band which includes the frequency at which the split ring resonator 100 resonates and which has a reflection coefficient S11 smaller than a predetermined value. Thus, the split ring resonator 100 has a plurality of operating frequencies. In other words, the antenna 10 has the plurality of operating frequencies. One of the operating frequencies is a low frequency at which the stub 12 has no significant electrical length and the split ring resonator 100 causes the LC resonance. Another one of the operating frequencies is an operating frequency corresponding to the electrical length of the stub 12.

In the antenna 10 of FIG. 1, the stub 12 and the split ring 14 can be distinguished from each other. However, the stub 12 and the split ring 14 may have a part shared by them. For example, in an antenna 20 shown in FIG. 2, a second conductor 230 forms a stub 22 together with a first conductor 220. At the same time, the second conductor 230 forms a split ring 24 with a split portion 26 together with a third conductor 240. Then, the stub 22 and the split ring 24 form a split ring resonator 200. As just described, at least one of the first conductor 220 and the second conductor 230 may form a part of the split ring 24. With this structure, the antenna 20 has a plurality of operating frequencies as with the antenna 10. In addition, since the second conductor 230 serves as both of a part of the stub 22 and a part of the split ring 24, the antenna 20 can be downsized in comparison with the antenna 10.

Figure 2:
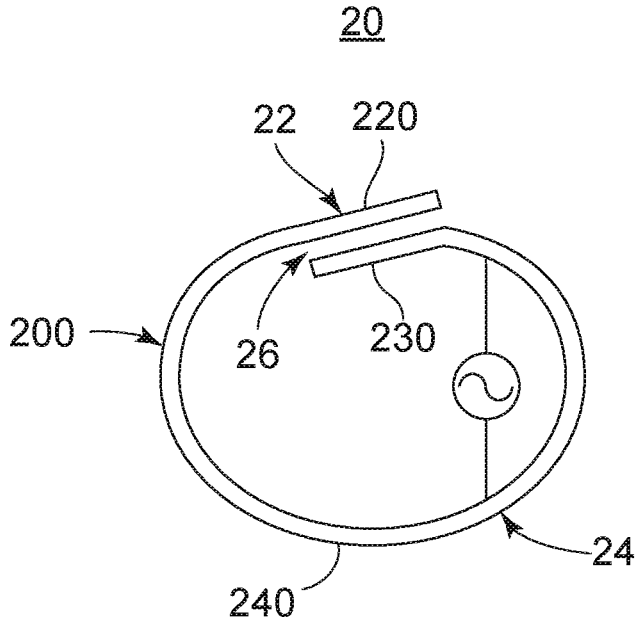
FIG. 2 is a diagram showing a modified example of the basic structure of the antenna of the present invention.

In the structure shown in FIG. 1 or 2, the stub 12 or 22 is an open stub in which each of the first conductor 120 or 220 and the second conductor 130 or 230 has an open end. However, the antenna of the present invention may have a short stub in which an end of the first conductor 120 or 220 and an end of the second conductor 130 or 230 are short-circuited to each other. In other words, the antenna of the present invention should be at least provided with the first conductor 120 or 220 and the second conductor 130 or 230 which form, at least in part, an open stub or a short stub which has the predetermined electrical length.

Figure 3:
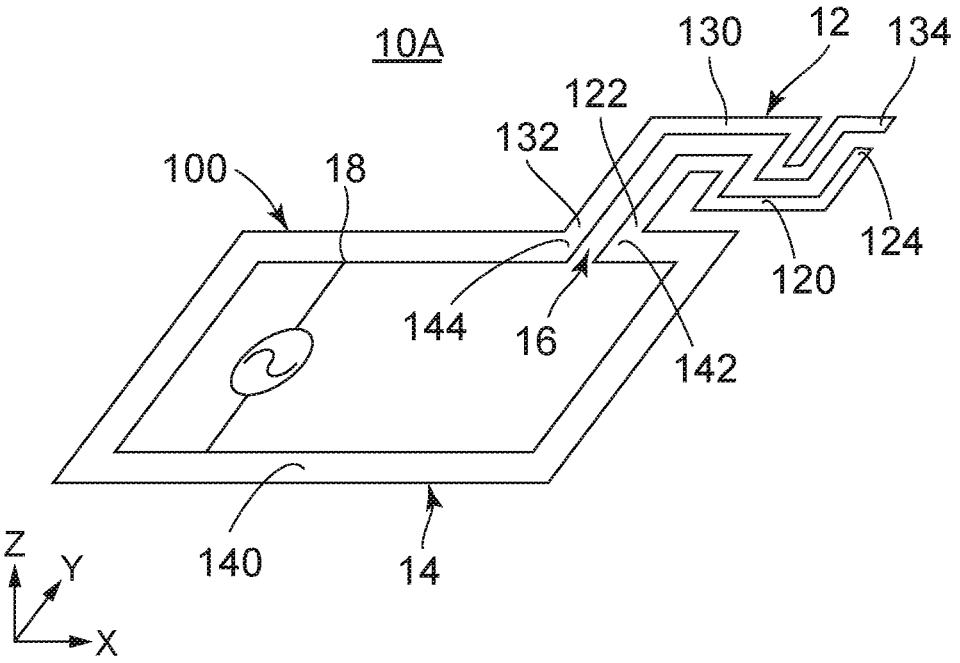
FIG. 3 is a schematic view showing an antenna according to a first embodiment of the present invention.

Referring to FIG. 3, an antenna 10A according to a first embodiment of the present invention has the same structure as the antenna 10 shown in FIG. 1. In other words, the antenna 10A is provided with the stub 12 and the split ring 14. In detail, the antenna 10A is provided with the first conductor 120, the second conductor 130 and the third conductor 140 which are arranged on the same plane. Materials of the first conductor 120, the second conductor 130 and the third conductor 140 are not particularly limited, provided that they are conductive materials. For example, each of the first conductor 120, the second conductor 130 and the third conductor 140 may be made of a metal plate. Alternatively, each of the first conductor 120, the second conductor 130 and the third conductor 140 may be made of a conductive film included in a circuit board. Moreover, the first conductor 120, the second conductor 130 and the third conductor 140 may be separate members or a single member in which they are united.

As shown in FIG. 3, each of the first conductor 120, the second conductor 130 and the third conductor 140 has a first end portion 122, 132 or 142 and a second end portion 124, 134 or 144. The first end portion 122 of the first conductor 120 is connected to the first end portion 142 of the third conductor 140. The first end portion 132 of the second conductor 130 is connected to the second end portion 144 of the third conductor 140.

As shown in FIG. 3, each of the first conductor 120 and the second conductor 130 has a shape with a plurality of elbow portions. The first conductor 120 and the second conductor 130 are juxtaposed with a predetermined interval therebetween to form the stub 12. In the present embodiment, the stub 12 is an open stub. In other words, both of the second end portion 124 of the first conductor 120 and the second end portion 134 of the second conductor 130 are open ends. The stub 12 has a predetermined electrical length. The predetermined electrical length is equal to or longer than a half of a wavelength ($=0.5\lambda$, $\lambda$: wavelength) corresponding to one of operation frequencies of the antenna 10A. In other words, the predetermined electrical length is equal to or more than 0.5 times a wavelength of any one of the operating frequencies. In the present embodiment, the electrical length of the stub 12 depends on an electrical length from the first end portion 122 of the first conductor 120 to the second end portion 124 of the first conductor 120 or on an electrical length from the first end portion 132 of the second conductor 130 to the second end portion 134 of the second conductor 130.

As shown in FIG. 3, the third conductor 140 forms the split ring 14 having a rectangular shape. The first end portion 142 of the third conductor 140 and the second end portion 144 of the third conductor 140 are located apart from each other and form the split portion 16 of the split ring 14. The third conductor 140 is provided with a feeding portion 18. The stub 12 works inductively or capacitively according to a frequency supplied thereto. Accordingly, the split ring resonator 100 formed of the stub 12 and the split ring 14 can have a plurality of resonance frequencies. Thus, the antenna 10A can have a plurality of operating frequencies.

In the antenna 10A shown in FIG. 3, the stub 12 is formed on the same plane as the split ring 14 and located outward of the split ring 14. However, the present invention is not limited thereto. As in an antenna 10B shown in FIG. 4, the first conductor 120 and the second conductor 130 which form the stub 12 may be provides inside the split ring 14.

With this structure, the antenna 10B can be downsized in comparison with the antenna 10A.

Figure 4:
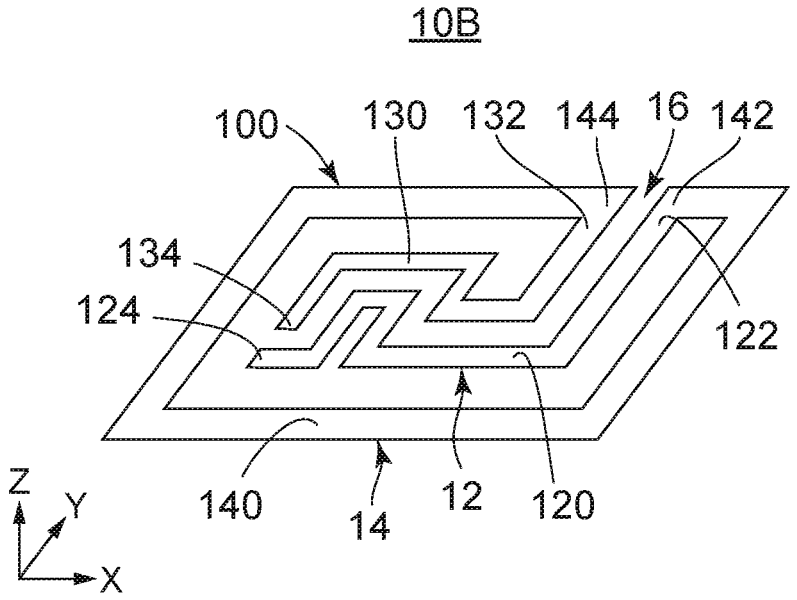
FIG. 4 is a schematic view showing a first modified example of the antenna according to the first embodiment of the present invention. A feeding portion is not shown.
Figure 5:
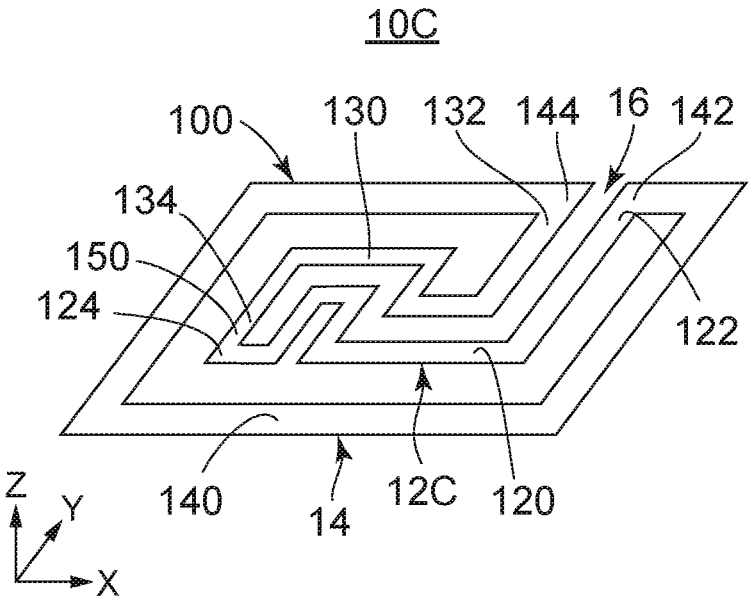
FIG. 5 is a schematic view showing a second modified example of the antenna according to the first embodiment of the present invention. A feeding portion is not shown.

In each of the antenna 10A shown in FIG. 3 and the antenna 10B shown in FIG. 4, the stub 12 is formed as the open stub. However, the present invention is not limited thereto. The stub 12 may be formed as a short stub. For example, as in an antenna 10C shown in FIG. 5, by connecting the second end portion 124 of the first conductor 120 and the second end portion 134 of the second conductor 130 to each other by means of a fourth conductor 150, a stub 12C can be formed as a short stub. However, the present invention is not limited thereto. In order to form the short stub, the first conductor 120 and the second conductor 130 should be connected to each other by means of the fourth conductor 150 at a position which is apart from the first end portion 142 of the third conductor 140 and the second end portion 144 of the third conductor 140. The electrical length of the stub 12C which is the short stub depends on the electrical length of the first conductor 120 or the electrical length of the second conductor 130. In addition, the electrical length (the predetermined electrical length) of the stub 12C is equal to or longer than three fourths of a wavelength (=0.75λ) corresponding to one of the operating frequencies. In other words, the predetermined electrical length is equal to or more than 0.75 times a wavelength of any one of the operating frequencies.

Figure 6:
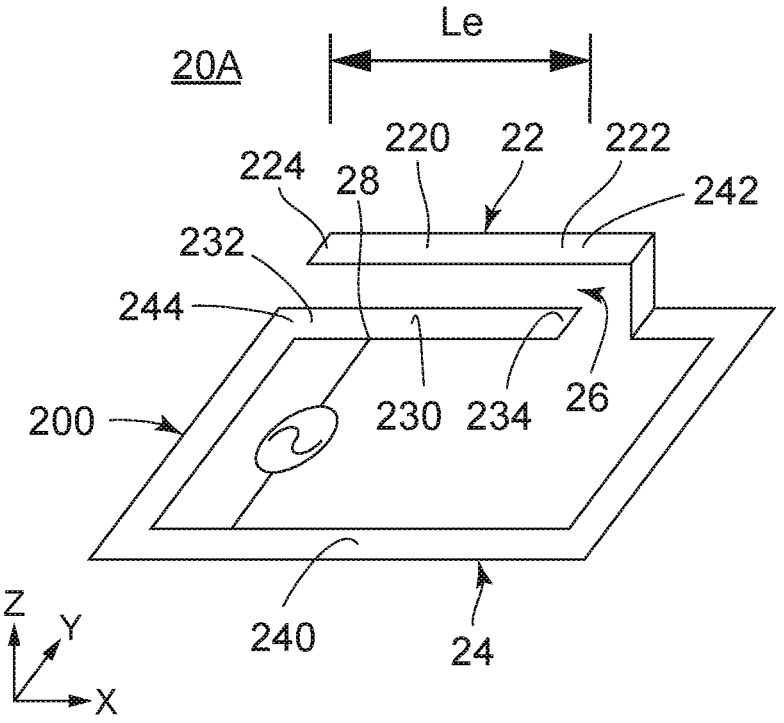
FIG. 6 is a schematic view showing an antenna according to a second embodiment of the present invention.

Referring to FIG. 6, an antenna 20A according to a second embodiment of the present invention has the same structure as the antenna 20 shown in FIG. 2. In other words, the antenna 20A is provided with the stub 22 and the split ring 24. In detail, the antenna 20A of FIG. 6 is provided with the first conductor 220, the second conductor 230 and the third conductor 240. Materials of the first conductor 220, the second conductor 230 and the third conductor 240 are not particularly limited, provided that they are conductive materials. Each of the first conductor 220, the second conductor 230 and the third conductor 240 may be formed of a metal plate. Alternatively, the first conductor 220, the second conductor 230 and the third conductor 240 may be formed of a plurality of conductive layers and vias included in a multilayer wiring substrate. Moreover, the first conductor 220, the second conductor 230 and the third conductor 240 may be formed as separate members or a single member in which they are united.

As shown in FIG. 6, each of the first conductor 220, the second conductor 230 and the third conductor 240 has a first end portion 222, 232 or 242 and a second end portion 224, 234 or 244. The first end portion 222 of the first conductor 220 is connected to the first end portion 242 of the third conductor 240. The first end portion 232 of the second conductor 230 is connected to the second end portion 244 of the third conductor 240.

As shown in FIG. 6, each of the first conductor 220 and the second conductor 230 has a rectangular shape long in a lateral direction. The first conductor 220 extends from the first end portion 222 thereof in a first lateral direction, and the second conductor 230 extends from the first end portion 232 thereof in a second lateral direction. The first conductor 220 and the second conductor 230 are arranged apart from each other in an up-down direction and in parallel with each other. In other words, the first conductor 220 and the second conductor 230 are apart from and face each other. In the up-down direction, the first conductor 220 is located upward of the second conductor 230. Thus, the first conductor 220 and the second conductor 230 form the stub 22. The antenna 20A of the present embodiment can reduce a footprint thereof since the stub 22 is formed three-dimensionally. In the present embodiment, the lateral direction is an X-direction. A negative X-direction is the first lateral direction while a positive X-direction is the second lateral direction. Moreover, in the present embodiment, the up-down direction is a Z-direction. A positive Z-direction is directed upward while a negative Z-direction is directed downward.

As understood from FIG. 6, in the present embodiment, the stub 22 is an open stub. In other word, each of the second end portion 224 of the first conductor 220 and the second end portion 234 of the second conductor 230 is an open end. The stub 22 has the electrical length Le depending on a length of the first conductor 220 or a length of the second conductor 230 in the lateral direction. The electrical length (the predetermined electrical length) Le is equal to or longer than a half of a wavelength (=0.5λ) corresponding one of operating frequencies of the antenna 20A.

As understood from FIG. 6, the second conductor 230 and the third conductor 240 form the split ring 24 having a rectangular shape. The third conductor 240 has two elbow portions so that the first end portion 242 is located upward of the second end portion 244 in the up-down direction.

As shown in FIG. 6, the second end portion 234 of the second conductor 230 and the first end portion 242 of the third conductor 240 are located apart from each other and form the split portion 26 in the split ring 24. The second conductor 230 is provided with a feeding portion 28. The stub 22 works inductively or capacitively according to a frequency supplied thereto. Accordingly, the split ring resonator 200 formed of the stub 22 and the split ring 24 can have a plurality of resonance frequencies. Thus, the antenna 20A can have a plurality of operating frequencies.

In the antenna 20A shown in FIG. 6, the feeding portion 28 is provided on the second conductor 230. However, the present invention is not limited thereto. The feeding portion 28 may be provided on the third conductor 240 according to a shape and a size of each of the first conductor 220, the second conductor 230 and the third conductor 240 and to an arrangement of them (see FIG. 2). In other words, in the antenna of this invention, the feeding portion 28 may be provided to either the second conductor 230 or the third conductor 240. Alternatively, the feeding portion 28 may be provided on the first conductor 220. In that case, it should be noted that a function of the first conductor 220 and a function of the second conductor 230 are changed to each other.

In the antenna 20A shown in FIG. 6, each of the first conductor 220 and the second conductor 230 has a rectangular shape long in the lateral direction. However, the present invention is not limited thereto. As in an antenna 20B shown in FIG. 7, the first conductor 220 may be formed into a meandering shape, and the second conductor 230 may be formed into a plane shape. To the contrary, the first conductor 220 may be formed into a plane shape, and the second conductor 230 may be formed into a meandering shape. Moreover, as in an antenna 20C shown in FIG. 8, the first conductor 220 may be formed into a spiral shape, and the second conductor 230 may be a plane shape. To the contrary, the first conductor 220 may be formed into a plane shape, and the second conductor 230 may be formed into a spiral shape. According to these structures, an electrical length of the stub 22 can be lengthen while upsizing of the antenna 20B or 20C can be avoided. The electrical length of the stub 22 depends on an electrical length of the first conductor 220 having the meandering or spiral shape or an electrical length of the second conductor 230 having the meandering or spiral shape.

Figure 7:
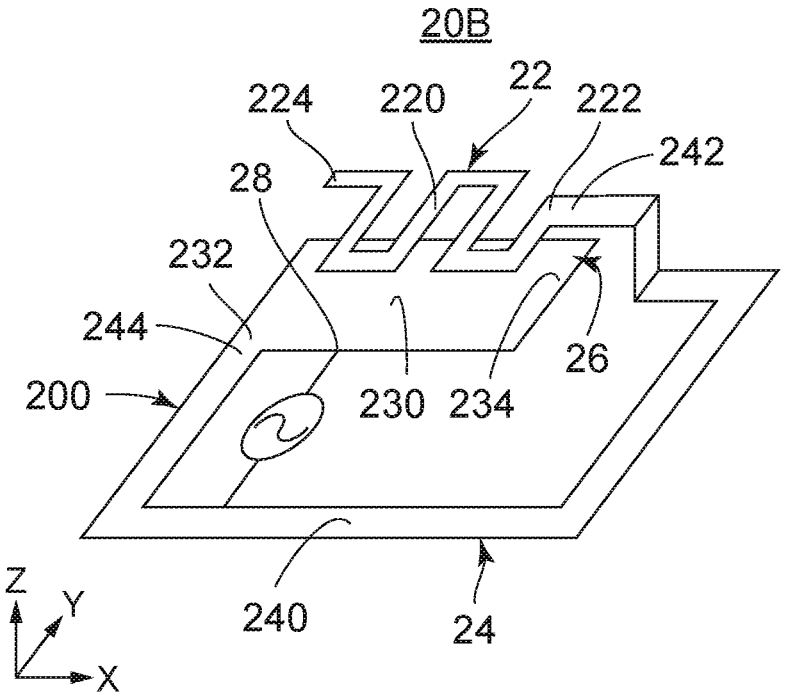
FIG. 7 is a schematic view showing a first modified example of the antenna according to the second embodiment of the present invention.
Figure 8:
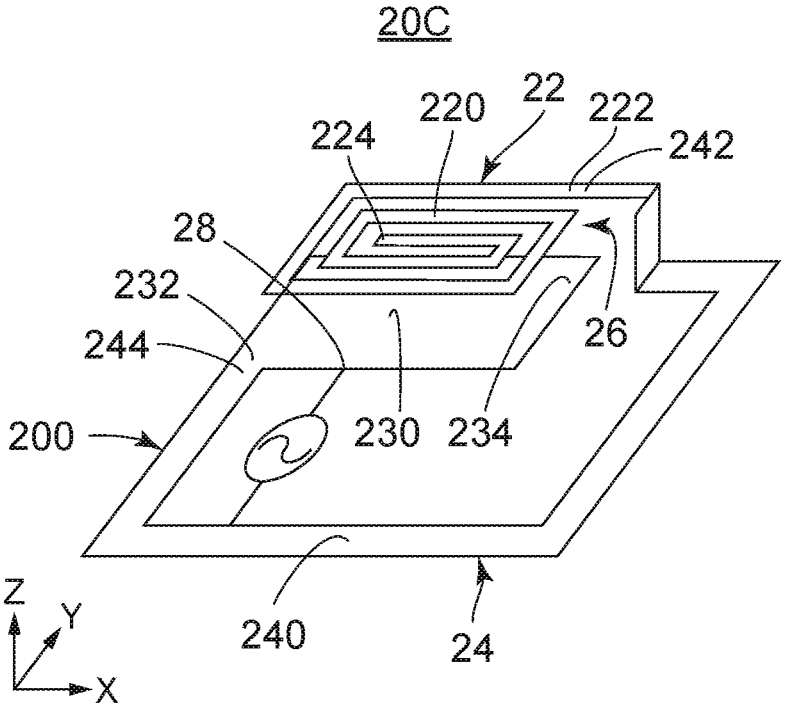
FIG. 8 is a schematic view showing a second modified example of the antenna according to the second embodiment of the present invention.
Figure 9:
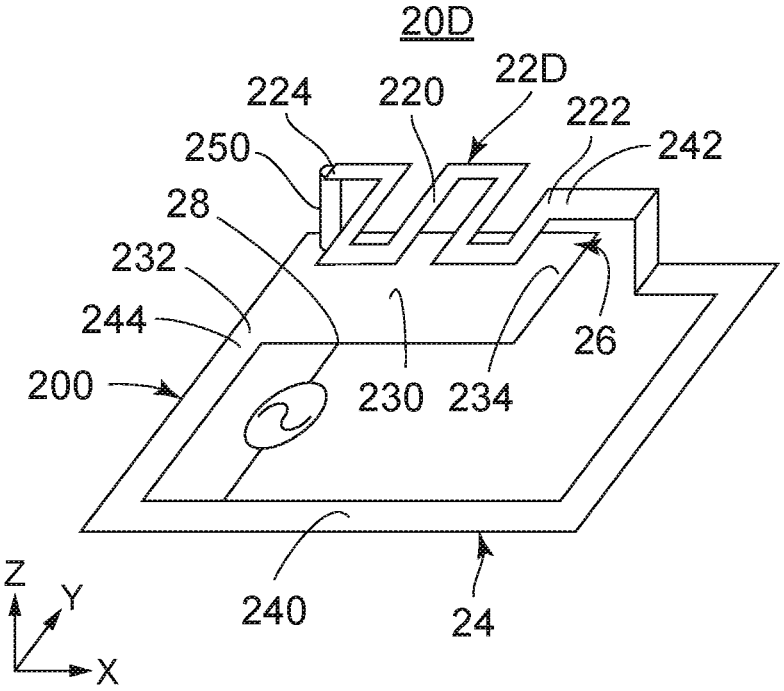
FIG. 9 is a schematic view showing a third modified example of the antenna according to the second embodiment of the present invention.
Figure 10:
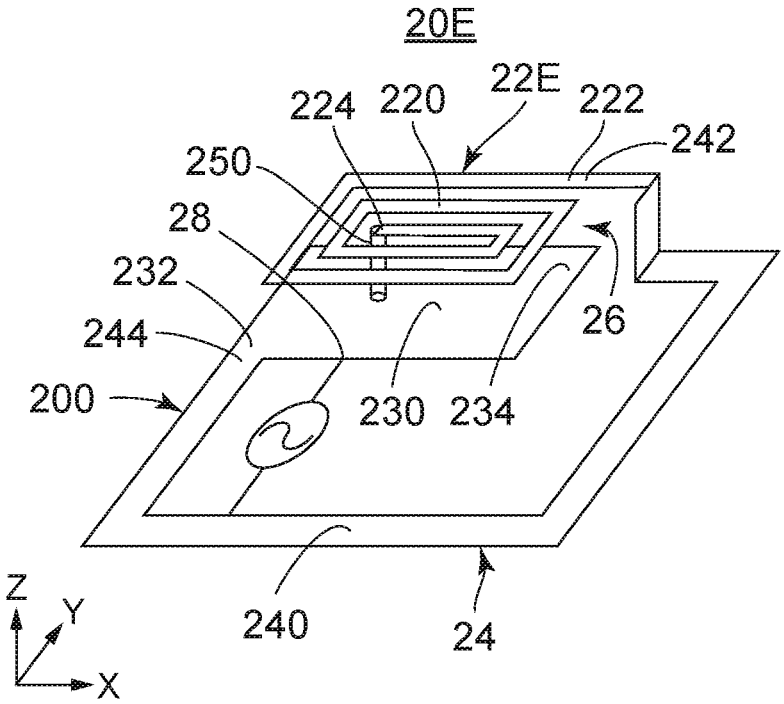
FIG. 10 is a schematic view showing a fourth modified example of the antenna according to the second embodiment of the present invention.

In each of the antennas 20A, 20B and 20C shown in FIGS. 6 to 8, the stub 22 is formed as the open stub. However, the present invention is not limited thereto. The stub 22 may be formed as a short stub. For example, as in each of an antenna 20D shown in FIG. 9 and an antenna 20E shown in FIG. 10, by connecting the second end portion 224 of the first conductor 220 and the second conductor 230 to each other by means of a fourth conductor 250, a stub 22D or 22E can be formed as a short stub. Here, a connecting position of the fourth conductor 250 on the first conductor 220 is not limited at the second end portion 224 but may be at the vicinity of the second end portion 224. By changing the connecting position of the fourth conductor 250, operating frequencies of the antenna 20D or 20E can be adjusted. Thus, the antenna of the present invention may be further provided with the fourth conductor 250 which connects the first conductor 220 and the second conductor 230 to each other at the second end portion 224 of the first conductor 220 or at the vicinity of the second end portion 224. The electrical length of the stub 22D or 22E depends on the electrical length of the first conductor 220 having the meandering or spiral shape. The electrical length of the stub 22D or 22E is equal to or longer than three fourths of a wavelength (=0.75λ) corresponding to one of the operating frequencies.

Figure 11:
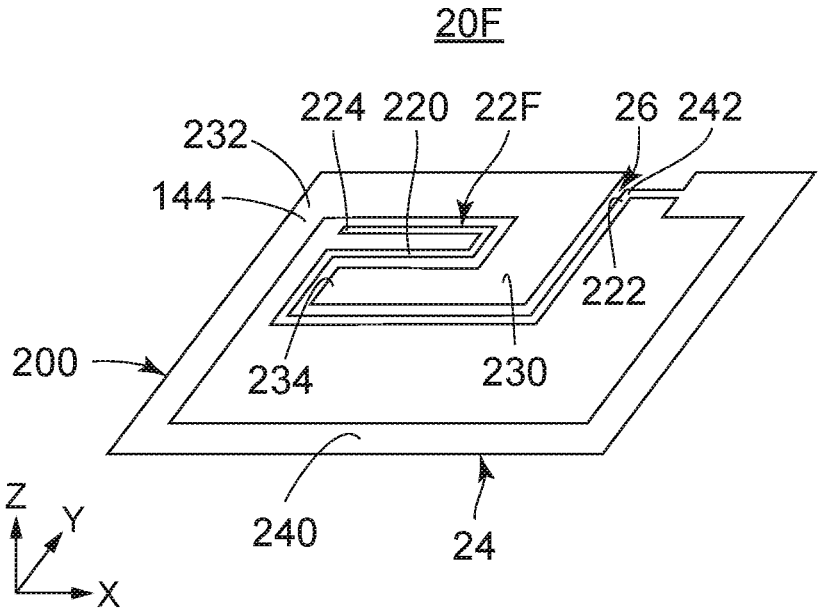
FIG. 11 is a schematic view showing a fifth modified example of the antenna according to the second embodiment of the present invention. A feeding portion is not shown.

In each of the antennas 20A, 20B, 20C, 20D and 20E, the stub 22, 22D or 22E is formed three-dimensionally. However, the present invention is not limited thereto. For example, as in an antenna 20F shown in FIG. 11, a stub 22F may be formed two-dimensionally. In the antenna 20F of FIG. 11, the first conductor 220 is disposed along an edge of the second conductor 230 with a predetermined interval therebetween. The first conductor 220 is formed to have a narrow width, and the second conductor 230 is formed to have a wide width. The first end portion 242 of the third conductor 240 has a width corresponding to the width of the first conductor 220. The antenna 20F having this structure also can have a plurality of operating frequencies.

Figure 12:
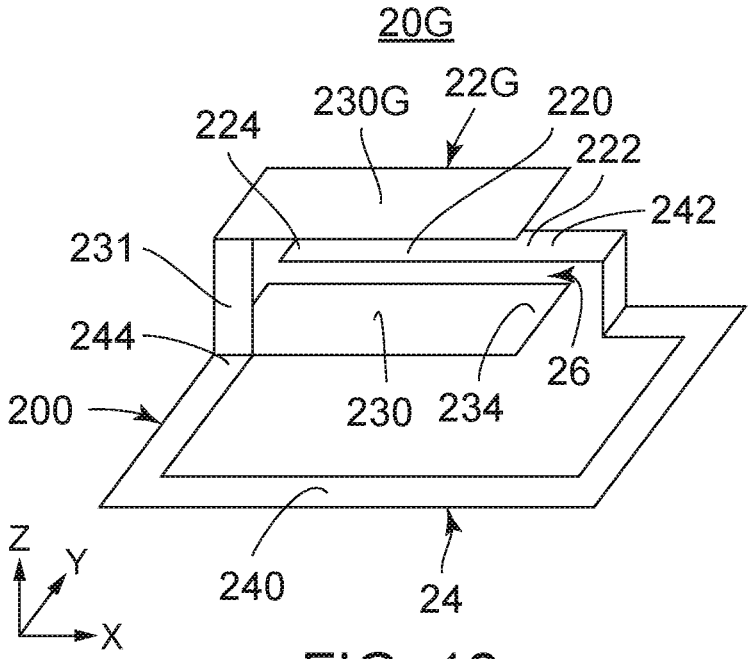
FIG. 12 is a schematic view showing a sixth modified example of the antenna according to the second embodiment of the present invention. A feeding portion is not shown.

Each of the antenna 20A, 20B, 20C, 20D, 20E and 20F shown in FIGS. 6 to 11, the stub 22, 22D, 22E or 22F is formed of two conductors, the first conductor 220 and the second conductor 230. However, the present invention is not limited thereto. The stub 22 may be formed of three or more conductors. For example, as in an antenna 20G shown in FIG. 12, an additional second conductor 230G arranged in parallel with the second conductor 230 may be provided. The additional second conductor 230G has the same shape and the same size as the second conductor 230. The additional second conductor 230G is connected to the second end portion 244 of the third conductor 240 by means of a connection portion 231. In the up-down direction, the first conductor 220 is located between the second conductor 230 and the additional second conductor 230G. In the up-down direction, a distance from the first conductor 220 to the second conductor 230 is equal to a distance from the first conductor 220 to the additional second conductor 230G. The antenna 20G having this structure can also have a plurality of operating frequencies.

Figure 13:
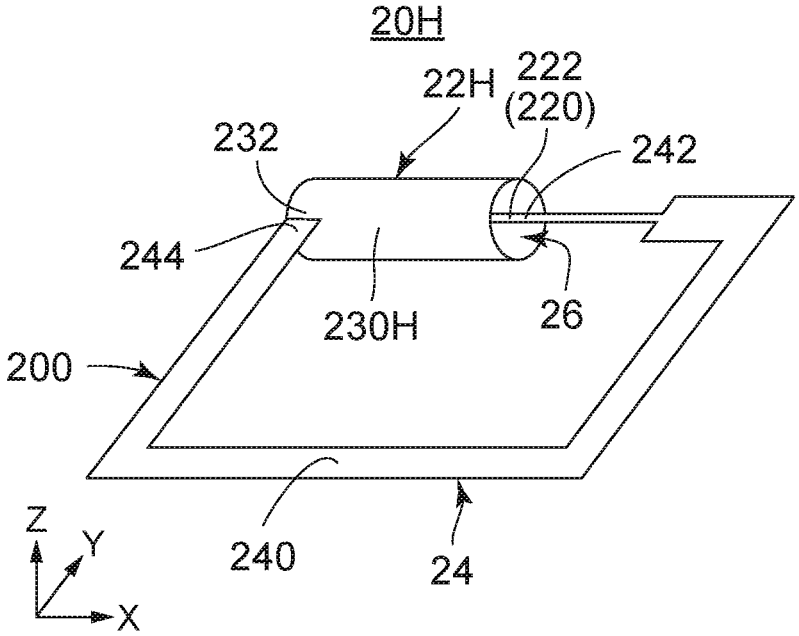
FIG. 13 is a schematic view showing a seventh modified example of the antenna according to the second embodiment of the present invention. A feeding portion is not shown.

In each of the antenna 20A, 20B, 20C, 20D, 20E and 20F, each of the first conductor 220 and the second conductor 230 has the plane shape. However, the present invention is not limited thereto. For example, as in an antenna 20H shown in FIG. 13, a stub 22H may be formed by means of a second conductor 230H having a cylindrical shape. The antenna 20H having this structure can also have a plurality of operating frequencies.

Figure 14:
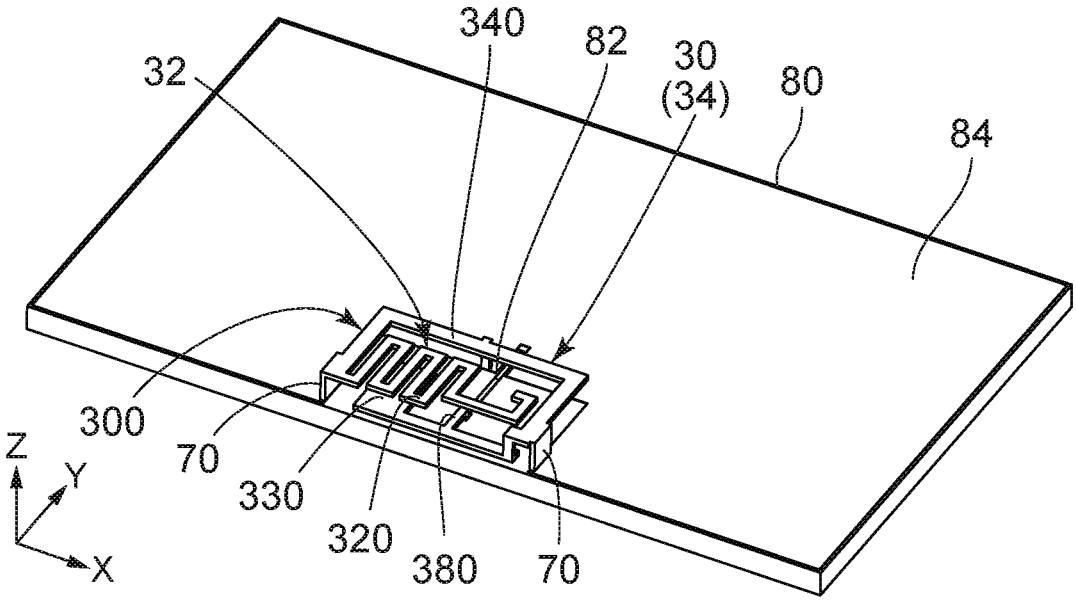
FIG. 14 is a perspective view showing an antenna device including an antenna according to a third embodiment of the present invention.

Referring to FIG. 14, an antenna 30 according to a third embodiment of the present invention is a discrete part which is mounted on a circuit board 80 when used. The circuit board 80 is formed with a feeding line 82 and a grand plane 84 which are electrically connected to the antenna 30. However, the present invention is not limited thereto. The antenna of the present invention may be formed by means of a plurality of conductive layers and a plurality of vias included in a multilayer wiring board. Alternatively, the antenna of the present invention may be formed by another method, such as plating metal films on a resin body or sticking metal bodies on a resin body.

As understood from FIGS. 15 to 21, the antenna 30 has a first conductor 320, a second conductor 330 and a third conductor 340. The first conductor 320, the second conductor 330 and the third conductor 340 form a stub 32 and a split ring 34. The stub 32 and the split ring 34 form a split ring resonator 300. In other words, the antenna 30 is provided with the split ring resonator 300 which is formed of the first conductor 320, the second conductor 330 and the third conductor 340. In the present embodiment, the first conductor 320, the second conductor 330 and the third conductor 340 are made of a single metal plate and formed integrally. However, the present invention is not limited thereto. The antenna 30 may be formed by means of a plurality of conductive members.

Figure 15:
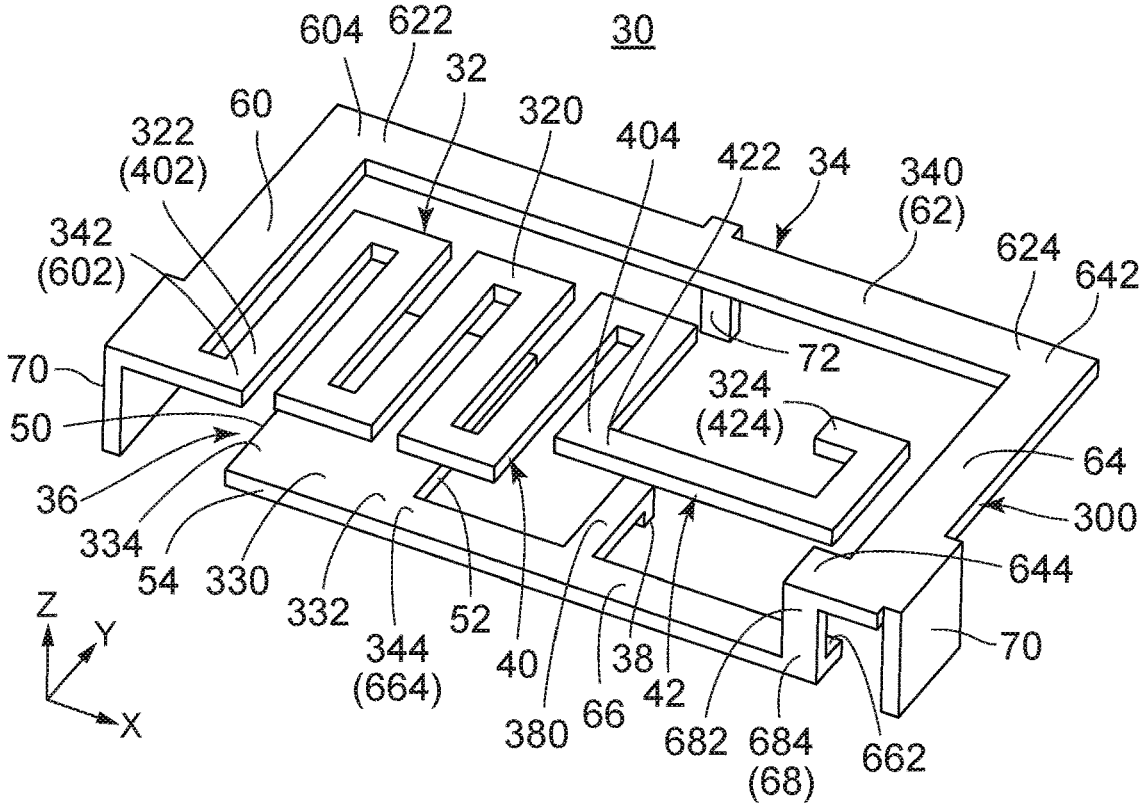
FIG. 15 is a perspective view showing the antenna included in the antenna device of FIG. 14.
Figure 16:
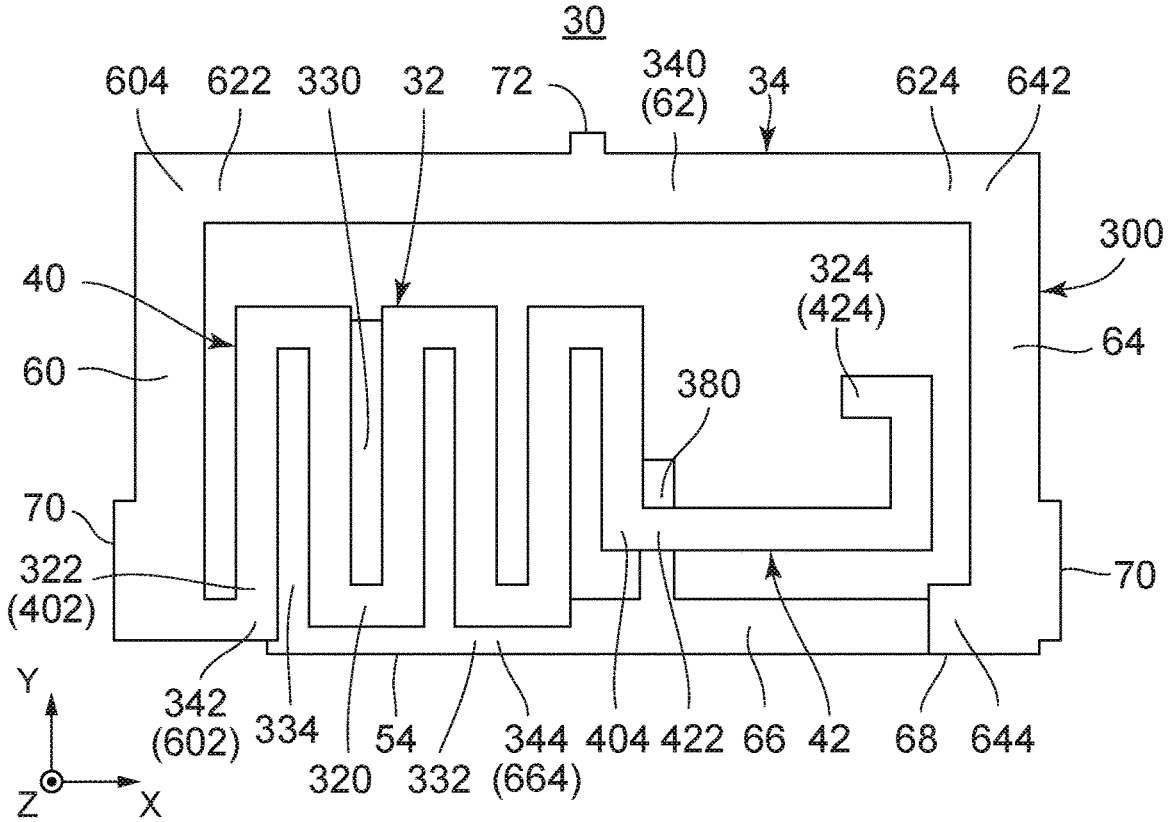
FIG. 16 is a top view showing the antenna of FIG. 15.
Figure 17:
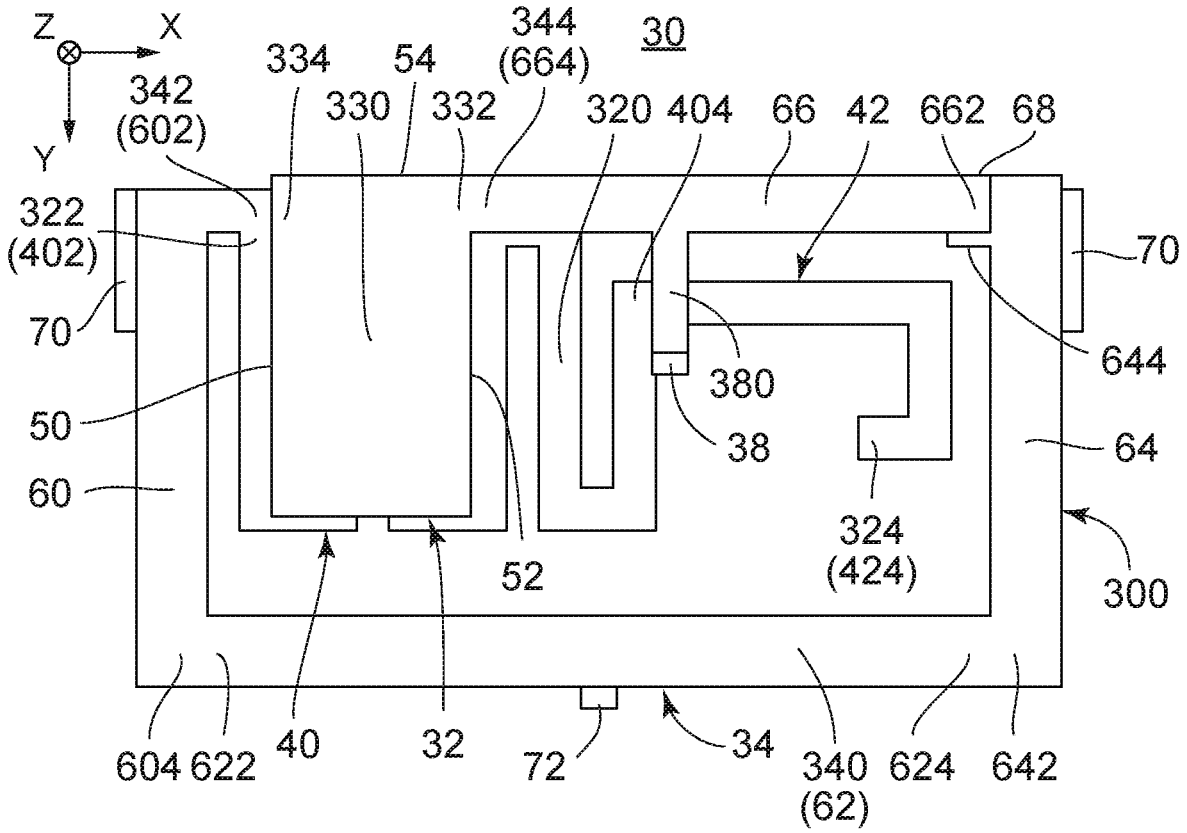
FIG. 17 is a bottom view showing the antenna of FIG. 15.

As shown in FIGS. 15 to 17, each of the first conductor 320, the second conductor 330 and the third conductor 340 has a first end portion 322, 323 or 342 and a second end portion 324, 334 or 344. The first end portion 322 of the first conductor 320 is connected to the first end portion 342 of the third conductor 340, and the first end portion 332 of the second conductor 330 is connected to the second end portion 344 of the third conductor 340.

As shown in FIGS. 15 and 16, the first conductor 320 has a meandering portion 40 and an extension portion 42. An end portion 402 of the meandering portion 40 is the first end portion 322 of the first conductor 320. Another end portion 404 of the meandering portion 40 is connected to an end portion 422 of the extension portion 42. Another end portion 424 of the extension portion 42 is the second end portion 324 of the first conductor 320. The extension portion 42 extends from the end portion 404 of the meandering portion 40 in the second lateral direction, then extends rearward and further extends in the first lateral direction. The first conductor 320 forms the stub 32 in part. An electrical length of the first conductor 320 defines an electrical length (a predetermined electrical length) of the stub 32.

As shown in FIG. 17, the second conductor 330 is a flat plate having a rectangular shape long in a front-rear direction. In the present embodiment, the front-rear direction is a Y-direction. A positive Y-direction is directed rearward while a negative Y-direction is directed frontward. The first end portion 332 of the second conductor 330 and the second end portion 334 of the second conductor 330 are a pair of side edge portions 52 and 50 and are provided at the vicinity of a front edge 54. The first end portion 332 of the second conductor 330 is connected to the second end portion 344 of the third conductor 340, and the second end portion 334 of the second conductor 330 is located near the first end portion 342 of the third conductor 340. The second end portion 334 of the second conductor 330 is not connected to the first end portion 342 of the third conductor 340 but located apart from the first end portion 342. The second conductor 330 and the third conductor 340 form the split ring 34, and the second end portion 334 of the second conductor 330 and the first end portion 342 of the third conductor 340 form a split portion 36 in the split ring 34. In the present embodiment, the second end portion 334 of the second conductor 330 is located downward of the first end portion 342 of the third conductor 340 in the up-down direction. In the up-down direction, the split portion 36 is located between the second end portion 334 of the second conductor 330 and the first end portion 342 of the third conductor 340.

Figure 18:
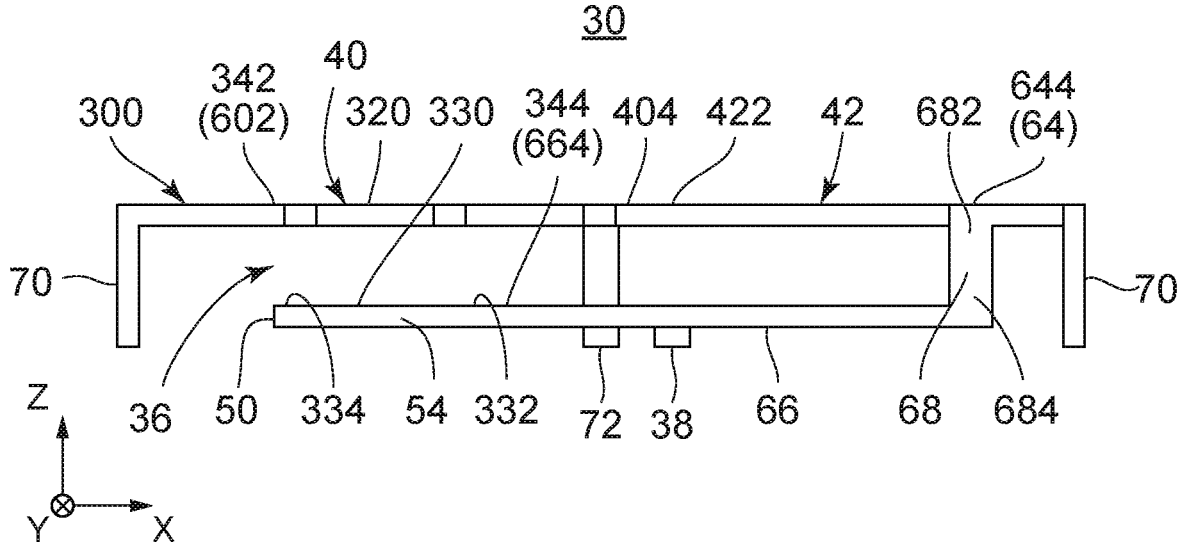
FIG. 18 is a front view showing the antenna of FIG. 15.
Figure 19:
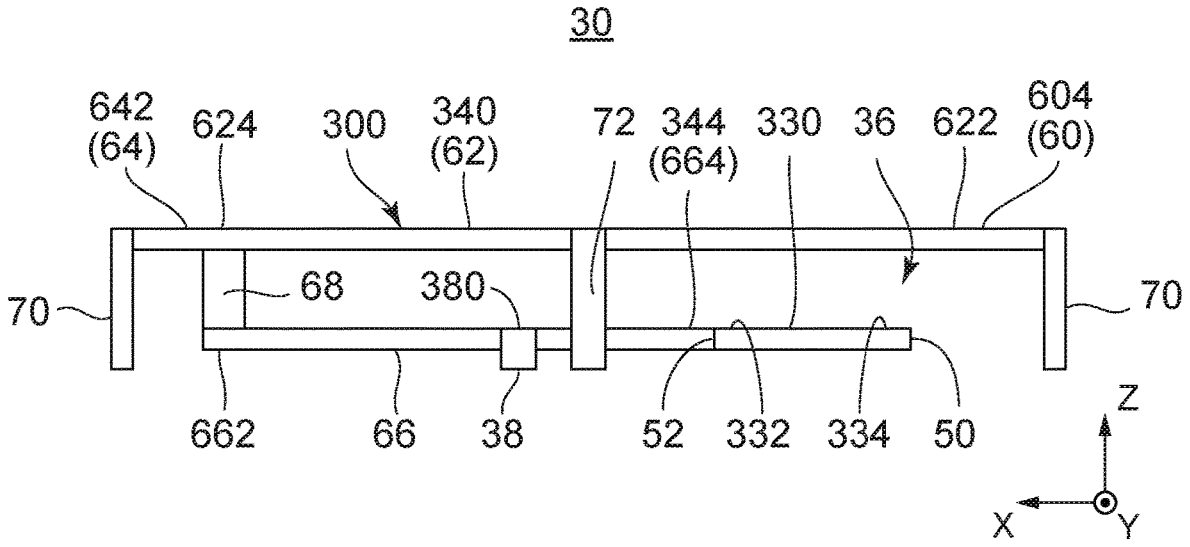
FIG. 19 is a rear view showing the antenna of FIG. 15.
Figure 20:
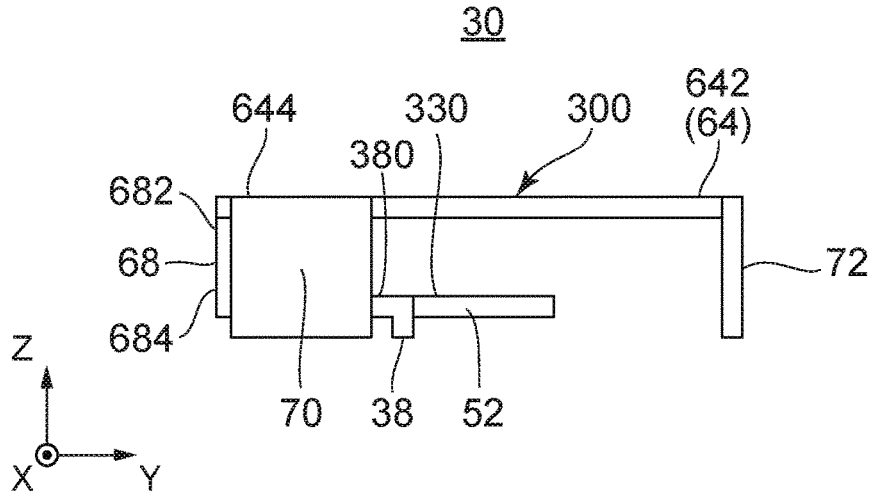
FIG. 20 is a right-side view showing the antenna of FIG. 15.
Figure 21:
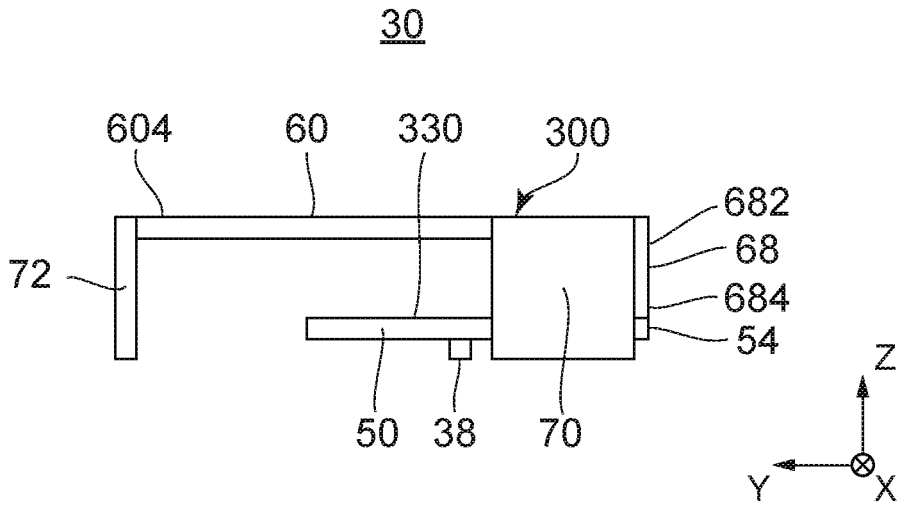
FIG. 21 is a left-side view showing the antenna of FIG. 15.

As understood from FIGS. 18 and 19, in the up-down direction, the second conductor 330 is located downward of the first conductor 320. As understood from FIGS. 16 and 17, when seen along the up-down direction, the first conductor 320 and the second conductor 330 overlaps with each other. In details, when seen along the up-down direction, the second conductor 330 overlaps with the meandering portion 40 of the first conductor 320. The second conductor 330 forms the stub 32 in part. Moreover, the first conductor 320 and the second conductor 330 form the stub 32 in part. The first conductor 320 and the second conductor 330 form the stub 32 at not only their parts identical with each other when seen along the up-down direction but also other parts of them. In other words, the first conductor 320 and the second conductor 330 form the stub 32 by arranging them near each other.

As understood from FIGS. 15 to 19, the third conductor 340 has a first portion 60, a second portion 62, a third portion 64, a fourth portion 66 and a joining portion 68. As shown in FIG. 16, the first portion 60 has an L-shape when seen along the up-down direction. The second portion 62 has an I-shape extending in the lateral direction when seen along the up-down direction. The third portion 64 has an inverted L-shape when seen along the up-down direction. As shown in FIG. 17, the fourth portion 66 has an I-shape extending in the lateral direction when seen along the up-down direction. As shown in FIG. 18, the joining portion 68 has an I-shape extending in the up-down direction when seen from the front thereof.

As shown in FIGS. 16 and 17, the first portion 60 of the third conductor 340 and the third portion 64 of the third conductor 340 are located outward of the first conductor 320 and the second conductor 330 in the lateral direction. Moreover, the second portion 62 of the third conductor 340 is located rearward of the first conductor 320 and the second conductor 330 in the front-rear direction. A front edge of the fourth portion 66 of the third conductor 340 is located frontward of the first conductor 320 and identical with the front edge 54 of the second conductor 330 in the front-rear direction.

As shown in FIGS. 15 and 16, an end portion 602 of the first portion 60 is the first end portion 342 of the third conductor 340. Another end portion 604 of the first portion 60 is connected to an end portion 622 of the second portion 62. Another end portion 624 of the second portion 62 is connected to an end portion 642 of the third portion 64. As shown in FIGS. 15 and 18, another end portion 644 of the third portion 64 is connected to an end portion 682 of the joining portion 68. Another end portion 684 of the joining portion 68 is connected to an end portion 662 of the fourth portion 66. As shown in FIGS. 15 and 17, another end portion 664 of the fourth portion 66 is the second end portion 344 of the third conductor 340.

As understood from FIGS. 15 to 17, the third conductor 340 forms the split ring 34 in part. In detail, the third conductor 340 forms the split ring 34 together with the second conductor 330.

As shown in FIG. 16, the third conductor 340 is arranged in parallel with the first conductor 320 in part. In detail, each of the fourth portion 66 of the third conductor 340, the third portion 64 of the third conductor 340 and the second portion 62 of the third conductor 340 is arranged in parallel with each portion of the extension portion 42 of the first conductor 320. With this structure, the third conductor 340 forms the stub 32 in part. In other words, in the present embodiment, the stub 32 is formed by means of not only the first conductor 320 and the second conductor 330 but a part of the third conductor 340.

As shown in FIGS. 15 to 19, the fourth portion 66 of the third conductor 340 is provided with a feeding portion 38. In detail, the feeding portion 38 is an end portion of a feeding line portion 380. The feeding line portion 380 is provided almost at the middle of the fourth portion 66 in the lateral direction. The feeding line portion 380 extends rearward from the fourth portion 66 and further extends downward. The feeding portion 38 is electrically connected to the feeding line 82 formed on the circuit board 80 (FIG. 14) when the antenna 30 is mounted on the circuit board 80. Here, an electrical connecting method between the feeding portion 38 and the feeding line 82 is not particularly limited. For example, the feeding portion 38 may be directly connected to the feeding line 82 by soldering or the like. Alternatively, the feeding portion 38 may be located near a part of the feeding line 82 with an interval therebetween to be connected capacitively or electromagnetically. At any rate, the feeding portion 38 and the feeding line 82 should be connected to each other so that the feeding portion 38 is supplied with electric power from the feeding line 82.

As shown in FIGS. 15 to 21, each of the first portion 60 of the third conductor 340 and the third portion 64 of the third conductor 340 is provided with a grounding portion 70. In detail, each of the grounding portions 70 has a rectangular plate shape. The grounding portions 70 are located outward of the third conductor 340 in the lateral direction. One of the grounding portions 70 is provided at a front end of a side edge of the first portion 60, and the other of the grounding portions 70 is provided at the vicinity of a front end of a side edge of the third portion 64. Each of the grounding portions 70 extends downward from the first portion 60 or the third portion 64. The grounding portions 70 are connected to the ground plane 84 formed in the circuit board 80 (see FIG. 14) when the antenna 30 is mounted on the circuit board 80.

As shown in FIGS. 15 to 21, the second portion 62 of the third conductor 340 is provided with a fixed portion 72. In detail, the fixed portion 72 extends downward from a rear edge of the second portion 62 at a middle part of the second portion 62 in the lateral direction. The fixed portion 72 is fixed to the circuit board 80 and supports the third conductor 340 when the antenna 30 is mounted on the circuit board 80 (FIG. 14). The fixed portion 72 may be connected to the ground plane 84 or not. Although the fixed portion 72 is one in number in the present embodiment, two or more fixed portions 72 may be provided.

As understood from FIG. 15, in the present embodiment, the first conductor 320 is provided with no fixed portion. However, one or more fixed portions may be provided to support the first conductor 320 on the circuit board 80 (see FIG. 14). For example, by providing a fixed portion 73 (see FIG. 22) to the extension portion 42 of the first conductor 320, deformation of the first conductor 320 can be prevented. The fixed portion provided to the first conductor 320 should not be connected to any conductive portion included in the circuit board 80 including the ground plane 84. Moreover, in the present embodiment, the second conductor 330 is also provided with no fixed portion. However, one or more fixed portions may be provided to the second conductor 330 as with the first conductor 220. Also, the fixed portion provided to the second conductor 330 should not be connected to the conductive portion included in the circuit board 80.

Although the stub 32 is the open stub in the present embodiment, it may be formed as a short stub. In that case, the second end portion 324 of the first conductor 320 should be connected to the second conductor 330. In the case of the open stub, the electrical length (the predetermined electrical length) of the stub 32 must be equal to or longer than a half of a wavelength (=0.5λ) corresponding to one of operating frequencies. On the other hand, in the case of the short stub, the electrical length (the predetermined electrical length) of the stub 32 must be equal to or longer than three fourths of a wavelength (=0.75λ) corresponding to one of operating frequencies. Thus, the stub 32 has the predetermined length, so that the antenna 30 also has a plurality of operating frequencies.

Figure 22:
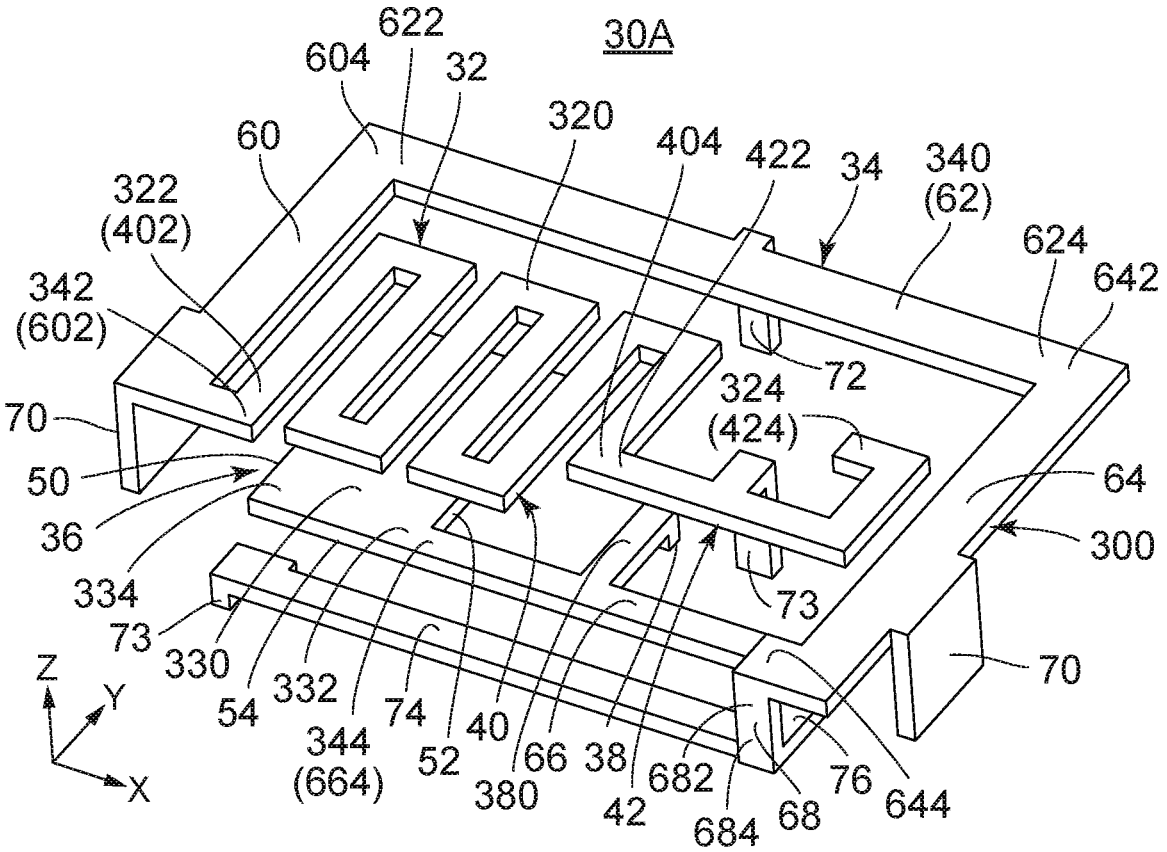
FIG. 22 is a perspective view showing a modified example of the antenna according to the third embodiment of the present invention.

Referring to FIG. 22, an antenna 30A according to a modified example of the third embodiment of the present invention is provided with a radiation element 74 in addition to the structure of the antenna 30. In the modified example, the radiation element 74 is integrally formed with other parts forming the antenna 30A. However, this invention is not limited thereto. The radiation element 74 may be formed as a different member different from the other parts forming the antenna 30A.

As shown in FIG. 22, the radiation element 74 is connected to the end portion 684 of the joining portion 68. The radiation element 74 extends from the end portion 684 of the joining portion 68 in the first lateral direction, and then slightly extends rearward. The radiation element 74 forms the so-called inverted L-shape antenna. The electrical length of the radiation element 74 is defined with reference to one fourth of a wavelength of one of operating frequencies of the antenna 30A. In other words, the electrical length of the radiation element 74 corresponds to one fourth of one of wavelengths of the operating frequencies of the antenna 30A.

As shown in FIG. 22, the radiation element 74 is provided with a fixed portion 73. The fixed portion 73 is fixed on the circuit board 80 (see FIG. 14) when the antenna 30A is mounted on the circuit board 80. However, the fixed portion 73 should not be connected to the conductive portion included in the circuit board 80. The fixed portion 73 supports the radiation element 74 mechanically. In the present embodiment, another fixed portion 73 is also provided to the first conductor 320.

As shown in FIG. 22, the fourth portion 66 of the third conductor 340 is connected to the end portion 684 of the joining portion 68 through an additional portion 76. The radiation element 74 and the fourth portion 66 are located on the same plane. The radiation element 74 and the fourth portion 66 are arranged in parallel with each other with an interval therebetween. With this structure, the radiation element 74 resonates with the split ring resonator 300 and enhances the function of the antenna 30A.

Although the specific explanation about the present invention is made above referring to the embodiments, the present invention is not limited thereto but susceptible of various modifications and alternative forms without departing from the spirit of the invention.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. An antenna having a split ring resonator, wherein:

the antenna comprises a first conductor and a second conductor which form, at least in part, an open stub or a short stub which has a predetermined electrical length, the first conductor and the second conductor forming a transmission line extending over the predetermined electrical length;

the antenna has a plurality of operating frequencies; and the first conductor and the second conductor are arranged apart from each other in a direction perpendicular to the split ring and are arranged in parallel with each other.

2. The antenna as recited in claim 1, wherein:

the antenna further comprises a third conductor and a feeding portion;

each of the first conductor, the second conductor, and the third conductor has a first end portion and a second end portion;

the first end portion of the first conductor is connected to the first end portion of the third conductor;

the first end portion of the second conductor is connected to the second end portion of the third conductor;

the second conductor and the third conductor form a split ring;

the second end portion of the second conductor and the first end portion of the third conductor are located apart from each other to form a split portion of the split ring; and the feeding portion is provided to the second conductor or the third conductor.

3. The antenna as recited in claim 2, wherein:

the antenna further comprises a fourth conductor which connects the first conductor and the second conductor to each other at the second end portion of the first conductor or a vicinity of the second end portion of the first conductor;

the first conductor, the second conductor, and the fourth conductor form the short stub; and the predetermined electrical length is at least 0.75 times a wavelength of any one of the operating frequencies.

4. The antenna as recited in claim 2, wherein:

the first conductor and the second conductor form the open stub; and the predetermined electrical length is at least 0.5 times a wavelength of any one of the operating frequencies.

5. The antenna as recited in claim 2, wherein the antenna further comprises a radiation element extending from the third conductor.

6. The antenna as recited in claim 5, wherein an electrical length of the radiation element corresponds to one fourth of a wavelength of any one of the operating frequencies.

7. The antenna as recited in claim 1, wherein:

the antenna further comprises a third conductor;

each of the first conductor, the second conductor, and the third conductor has a first end portion and a second end portion;

the first end portion of the first conductor is connected to the first end portion of the third conductor;

the first end portion of the second conductor is connected to the second end portion of the third conductor;

the third conductor forms a split ring; and the first end portion of the third conductor and the second end portion of the third conductor are located apart from each other to form a split portion of the split ring.

8. The antenna as recited in claim 7, wherein:

the antenna further comprises a fourth conductor which connects the first conductor and the second conductor to each other at a position distant from the first end portion of the third conductor and the second end portion of the third conductor;

the first conductor, the second conductor, and the fourth conductor form the short stub; and the predetermined electrical length is at least 0.75 times a wavelength of any one of the operating frequencies.

* * * * *